US008822963B2

(12) United States Patent
Loewen et al.

(10) Patent No.: US 8,822,963 B2
(45) Date of Patent: Sep. 2, 2014

(54) VAPOR FORMING APPARATUS, SYSTEM AND METHOD FOR PRODUCING VAPOR FROM RADIOACTIVE DECAY MATERIAL

(75) Inventors: Eric P. Loewen, Wilmington, NC (US); Jordan E. Hagaman, Wilmington, NC (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 227 days.

(21) Appl. No.: 13/340,145

(22) Filed: Dec. 29, 2011

(65) Prior Publication Data

US 2013/0167531 A1 Jul. 4, 2013

(51) Int. Cl.
*G21F 5/10* (2006.01)

(52) U.S. Cl.
USPC ..... 250/505.1; 250/506.1; 60/644.1

(58) Field of Classification Search
USPC ..... 250/505.1, 506; 60/644.1
See application file for complete search history.

(56) References Cited

U.S. PATENT DOCUMENTS 4,291,536 A * 9/1981 Girard ..... 60/644.1
4,805,407 A * 2/1989 Buchanan ..... 60/517
5,512,253 A 4/1996 Woodbridge et al.
5,584,193 A * 12/1996 Biermann ..... 62/476
5,771,265 A 6/1998 Montazer
6,802,671 B1 * 10/2004 Badie et al. ..... 405/129.55
8,222,624 B2 * 7/2012 Yanke et al. ..... 250/506.1
2009/0001294 A1 * 1/2009 Lee et al. ..... 250/505.1

FOREIGN PATENT DOCUMENTS

CA 1041776 A1 11/1978
JP 20060010330 A 1/2006

OTHER PUBLICATIONS

SE Report of Office Action issued in connection with corresponding SE Patent Application No. 1251402-2 dated on Dec. 5, 2013.

* cited by examiner

*Primary Examiner* — Michael Maskell
(74) *Attorney, Agent, or Firm* — Harness, Dickey & Pierce, PLC

(57) ABSTRACT

Example embodiments include a vapor forming apparatus, system and/or method for producing vapor from radioactive decay material. The vapor forming apparatus including an insulated container configured to enclose a nuclear waste container. The nuclear waste container includes radioactive decay material. The insulated container includes an inlet valve configured to receive vapor forming liquid. The radioactive decay material transfers heat to the vapor forming liquid. The insulated container also includes an outlet valve configured to output the vapor forming liquid heated by the radioactive decay material.

18 Claims, 4 Drawing Sheets

VAPOR FORMING APPARATUS, SYSTEM AND METHOD FOR PRODUCING VAPOR FROM RADIOACTIVE DECAY MATERIAL

BACKGROUND

Nuclear fuel rods are removed from nuclear power plants when their temperature is not high enough to generate vapor needed to produce electricity. The problem of what to do with used nuclear fuel has plagued the industry since commercialization of nuclear reactors started with the Atomic Energy Act of 1954. The inability of the United States to fully implement the Nuclear Waste Policy Act of 1982 and the utilities inability to use the Private Fuel Storage facility indicate that the problem has not been solved. The report from the Blue Ribbon Commission on America's Nuclear Future recommends storing the used radioactive decay material in an interim storage unit. Interim storage, however, produces no revenue and does not put the radioactive heat to any use.

SUMMARY

Example embodiments include a vapor forming apparatus, system and/or method for producing vapor from radioactive decay material.

The vapor forming apparatus including an insulated container configured to enclose a nuclear waste container. The nuclear waste container includes radioactive decay material. The insulated container includes an inlet valve configured to receive vapor forming liquid. The radioactive decay material transfers heat to the vapor forming liquid. The insulated container also includes an outlet valve configured to output the vapor forming liquid heated by the radioactive decay material.

In one embodiment, the vapor forming liquid includes a mixture of one of (1) water and acetone and (2) water and alcohol.

The vapor forming apparatus may include at least one thermocouple configured to monitor the heat transferred to the vapor forming liquid. The insulated container may include a removable closure to insert the nuclear waste container into the insulated container.

The vapor forming system includes a storage unit configured to hold vapor forming liquid, and a plurality of vapor forming apparatuses that are connected to each other in series. Each of the plurality of vapor forming apparatuses includes an insulated container configured to enclose a nuclear waste container. The nuclear waste container includes radioactive decay material. The vapor forming system also includes a pumping unit configured to pump the vapor forming liquid from the storage unit and transfer the vapor forming liquid through each insulated container of the plurality of vapor forming apparatuses where the radioactive decay material transfers heat to the vapor forming liquid in each stage, a switching valve unit configured to receive the vapor forming liquid from a last vapor forming apparatus of the plurality of vapor forming apparatus, and a control unit configured to control the switching valve unit to output vapor of the vapor forming liquid if at least one property of the vapor forming liquid is above a threshold.

The control unit is configured to control the switching valve unit to output the vapor forming liquid via a bypass line to the storage unit if the at least one property of the vapor forming liquid is equal to or below the threshold.

In one embodiment, the vapor forming liquid includes a mixture of one of (1) water and acetone and (2) water and alcohol. The at least one property of the vapor forming liquid may include temperature and pressure.

The vapor forming system also includes a pressure monitoring unit configured to monitor the pressure of the vapor forming liquid, and a temperature monitoring unit configured to monitor the temperature of the vapor forming liquid. The control unit is configured to receive temperature information and pressure information from the temperature monitoring unit and the pressure monitoring unit, respectively, and configured to control the switching valve unit based on the temperature information and the pressure information.

In one embodiment, the pressure monitoring unit and the temperature monitoring unit are connected between an outlet valve of the plurality of vapor forming apparatuses and the switching valve unit.

The control unit controls the switching valve unit to output the vapor of the vapor forming liquid if the pressure and temperature are high enough for energy conversion to occur, and the control unit controls the switching valve unit to output the vapor forming liquid via a bypass line to the storage unit if the pressure and temperature are not high enough for energy conversion to occur.

The insulated container for each vapor forming apparatus includes a removable closure to insert the nuclear waste container into the insulated container.

The vapor forming system may include a power module generator configured to receive the vapor from the switching valve unit and generate electrical energy based on the vapor.

The method includes transferring vapor forming liquid through a plurality of vapor forming apparatuses that are connected to each other in series. Each of the plurality of vapor forming apparatuses includes an insulated container configured to enclose a nuclear waste container. The nuclear waste container includes radioactive decay material. The radioactive decay material transfers heat to the vapor forming liquid. The method further includes outputting vapor of the vapor forming liquid from a last vapor forming apparatus of the plurality of vapor forming apparatuses if at least one property of the vapor forming liquid is above a threshold.

The method may further include outputting the vapor forming liquid via a bypass line to a storage unit if the at least one property of the vapor forming liquid is equal to or below the threshold. The storage unit holds the vapor forming liquid to be supplied to a first vapor forming apparatus of the plurality of vapor forming apparatuses.

In one embodiment, the vapor forming liquid includes a mixture of one of (1) water and acetone and (2) water and alcohol. The at least one property of the vapor forming liquid may include temperature and pressure.

The method may further include monitoring the temperature and pressure of the vapor forming liquid. The outputting step outputs the vapor of the vapor forming liquid if the pressure and temperature are high enough for energy conversion to occur. The outputting step outputs the vapor forming liquid via a bypass line to a storage unit if the pressure and temperature are not high enough for energy conversion to occur.

DETAILED DESCRIPTION

Figure 1:
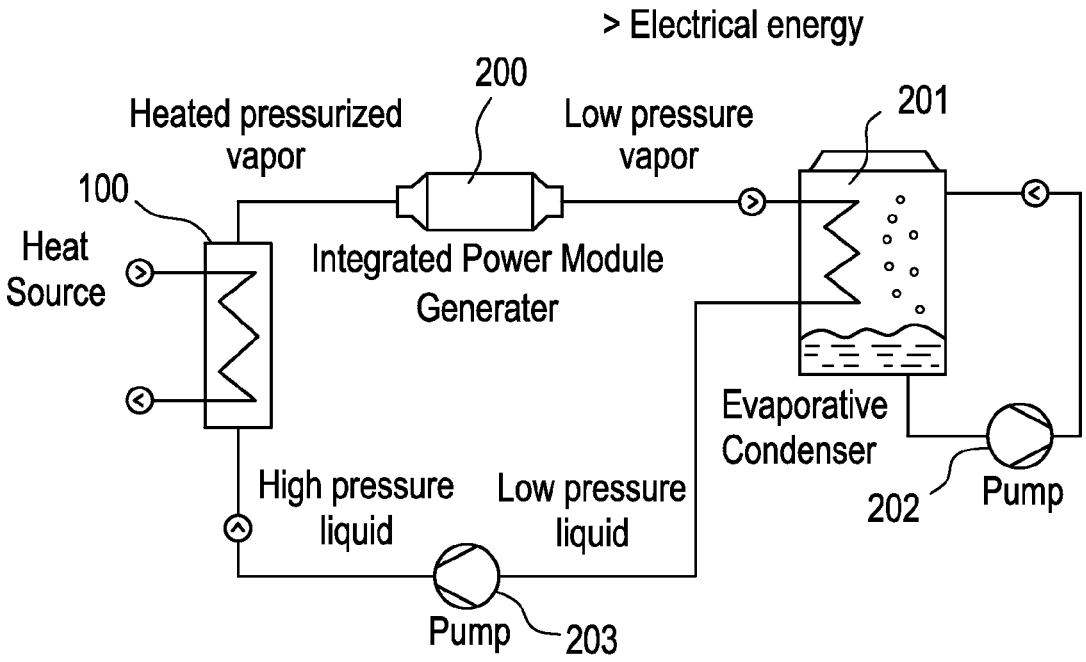
FIG. 1 illustrates a coolant and vapor circuit that generates electrical energy from a heat source according to an example embodiment.

Hereinafter, example embodiments will be described in detail with reference to the attached drawings. However, specific structural and functional details disclosed herein are merely representative for purposes of describing example embodiments. The example embodiments may be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures or described in the specification. For example, two figures or steps shown in succession may in fact be executed in series and concurrently or may sometimes be executed in the reverse order or repetitively, depending upon the functionality/acts involved.

Example embodiments include a vapor forming apparatus that utilizes radioactive decay material to generate vapor from vapor forming liquid. The radioactive decay material may include concentrated fission products. The concentrated fission product may be a certain percentage of the mass of used fuel. The radioactive decay material is placed into nuclear waste containers. An insulated container is used to enclose each nuclear waste container. Example embodiments provide a system and method that transfers the vapor forming liquid through each insulated container, where the radioactive decay material transfers heat to the vapor forming liquid. If the properties of the vapor forming liquid are above a threshold level (e.g., the pressure and temperature are above a certain level), vapor is output to a subsequent process or system such as a coolant and vapor circuit that generates electrical energy based on the generated vapor. These features are further explained with reference to FIGS. 1-6.

FIG. 1 illustrates a coolant and vapor circuit that generates electrical energy from a heat source according to an example embodiment.

The coolant and vapor circuit includes a heat source 100, an integrated power module generator 200, an evaporative condenser 201, a first pump 202, and a second pump 203. The coolant and vapor circuit may include other components that are well known to one of ordinary skill in the art for producing electrical energy from a heat source. The heat source 100 generates pressurized vapor. The details of the heat source 100 are further explained with reference to FIGS. 2-3. The integrated power module generator 200 generates electrical energy based on the heated pressurized vapor received from the heat source 100. The generation of electrical energy utilizing heated pressurized vapor may be performed according to methods that are well known to one of ordinary skill in the art.

The integrated power module 200 outputs low pressure vapor to the evaporative condenser 201. The evaporative condenser 201 may be any type of device or unit that condenses vapor into liquid. The evaporative condenser 201 generates low pressure liquid by condensing the low pressure vapor into liquid. The first pump 202 transfers the vapor-liquid mixture back to the evaporative condenser 201 until the vapor liquid mixture has been converted to the low pressure liquid. The evaporative condenser 201 outputs low pressure liquid, which is converted to high pressure liquid via the second pump 203. The high pressure liquid is fed back into the heat source 100.

Figure 2:
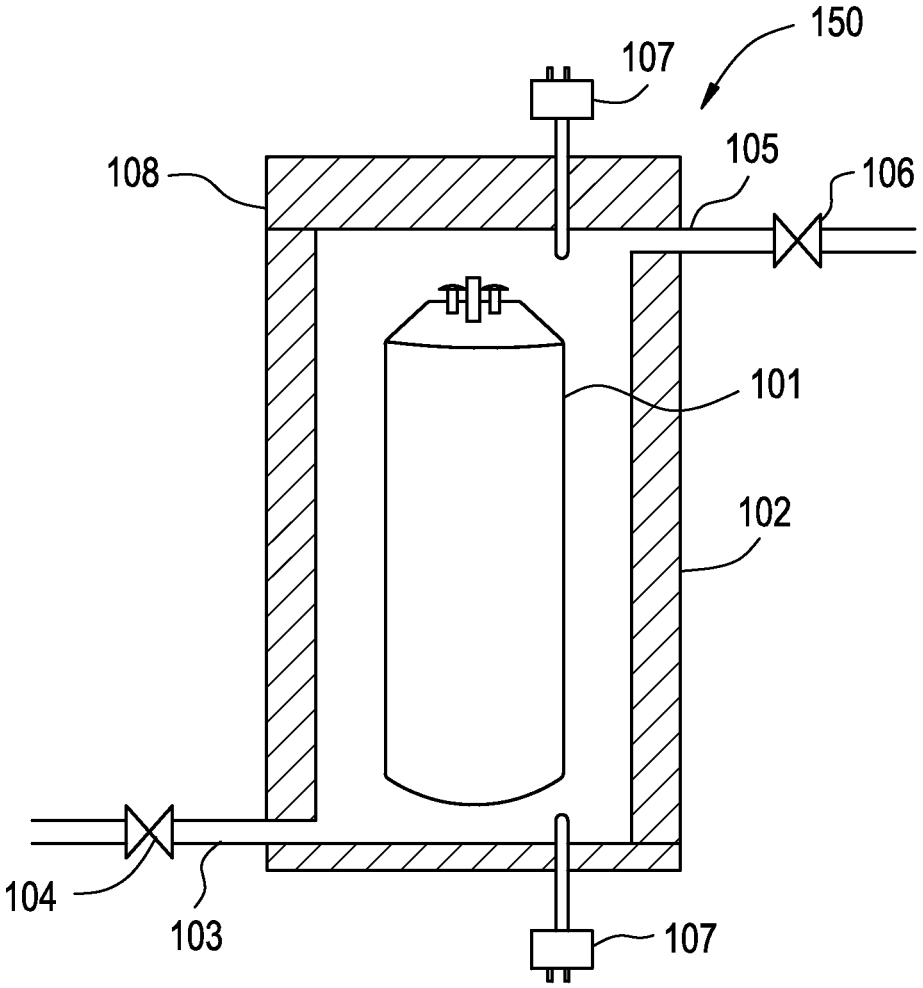
FIG. 2 illustrates a vapor forming apparatus according to an example embodiment.

FIG. 2 illustrates a vapor forming apparatus 150 according to an example embodiment.

The vapor forming apparatus 150 includes an insulated container 102 enclosing a nuclear waste container 101, an inlet 103, an inlet valve 104, an outlet 105, an outlet valve 106, thermocouples 107, and a removable closure 108. The vapor forming apparatus 150 or the plurality of vapor forming apparatuses 150 (shown in FIG. 3) may operate as the heat source 100 of FIG. 1.

The nuclear waste container 101 includes radioactive decay material. According to an embodiment, the radioactive decay material may be concentrated fission products. The concentrated fission products may be a certain percentage of the mass of used nuclear fuel. In one embodiment, the concentrated fission products are four percent of the used fuel. Further, the concentrated fission products are placed in a robust material form, which can be placed into a coolant that can be vaporized under environmentally controlled conditions, as further described below. The forms are robust if after the coolant is removed, the concentrated fission products still maintain their form under passive heat removal conditions. In one embodiment, the concentrated fission products may be metallic or ceramic or both. The nuclear waste container 101 may be a thick walled metal container that is leak tight, similar to that which has been used previously for storing nuclear waste.

Referring to FIG. 2, the nuclear waste container 101 is lowered though the removable closure 108 for location inside the insulated container 102. For example, the removable closure 108 is configured to insert the nuclear waste container 101 into the insulated container 102. The insulated container 102 and the removable closure 108 may be insulated such that all or substantially all the heat generated in the waste package is absorbed by the fluid rather than lost to the environment. The inlet valve 104 is configured to receive vapor forming liquid, where the vapor forming liquid is transferred inside the insulated container via the inlet 103. In order to regulate the vapor formation both in amount and quality, example embodiments may use a mixture of two fluids such as water and acetone or water and alcohol such that for startup there is more water in the system for passive heat removal. However, the vapor forming liquid of the example embodiments may be any type of solution or mixture that undergoes a phase change from a liquid to a vapor with heat input.

Also, it is noted that when vapor formation is desired for electrical production, the use of the radioactive heat is used to shift the mixture to higher concentration of the more volatile organic liquid thus increasing the vapor content of the fluid. The vapor formation is controlled by the coolant flow rate and system pressure. The inventors have recognized that the shifting of the fluid vapor point by controlling the composition of the coolant uses standard chemical distillation techniques.

The vapor forming liquid flows around the nuclear waste container 101, and the radioactive decay material contained inside the nuclear waste container 101 transfers heat to the vapor forming liquid. The radioactive decay material transfers heat to the vapor forming liquid according to the following equations:

$$A(t)=A_0\cdot e^{-\lambda t} \quad \text{Eq. (1)}$$

$$Q'=w\cdot h\cdot \Delta T \quad \text{Eq. (2)}$$

Eq. (1) represents a time-dependent activity A. The time-dependent activity A may be replaced by any number of quantities including the gamma production rate or the heat rate. The parameter $A_0$ represents the initial value such as the initial gamma production rate or the initial heat rate. The parameter $\lambda$ is the nominal aggregated decay constant. The nominal aggregated decay constant is further explained below. The parameter t is the cooling time.

Eq. (2) is the linear heat generation rate in power per channel length. The parameter w is the mass flow rate, the parameter h is the linear heat transfer coefficient and the parameter $\Delta T$ is the change in temperature for the vapor forming liquid.

Based on Eqs. (1) and (2), it can be seen that the maximum heat of the system is determined by the mass of fission products and the nominal decay constant of the fission products. The unique fission products from a typical light water reactor (LWR) system number over 700, all with different decay constants and concentrations. As such, the example embodiments utilizes an aggregated decay constant. The aggregated decay constant may be approximated from time-dependent specific heat generation data that is provided by NRC Regulatory Guide 3.54 Rev 1. This data provides sample values for which to fit a decay curve.

In one embodiment, the nuclear waste container 101 includes discharged nuclear fuel material after the discharged nuclear fuel material has cooled for ten years, for example. However, the example embodiments encompass discharged nuclear fuel material that has been cooled for any number of years. The decay heat rate of the fission products in the used fuel level off such that for an additional ten years, a relatively constant heat rate may be achieved. Furthermore, if the fission products are in use for thirty years, the heat rate decays to approximately 50%. These features are further explained with reference to FIGS. 4-6.

The thermocouples 107 are configured to monitor the heat transferred to the vapor forming liquid. In one embodiment, one thermocouple 107 may be placed toward the top portion of the insulated container 102 and another thermocouple 170 may be placed toward the bottom portion of the insulated container 102. However, the example embodiment encompass any number of thermocouples and encompass the placement of such thermocouples in any location of the insulated container 102.

The outlet valve 106 is configured to output the vapor forming liquid from the outlet 105 that has been heated by the radioactive decay material. In other words, hot fluid leaves the insulated container 102 flowing out the outlet 105 through the outlet valve 106.

Figure 3:
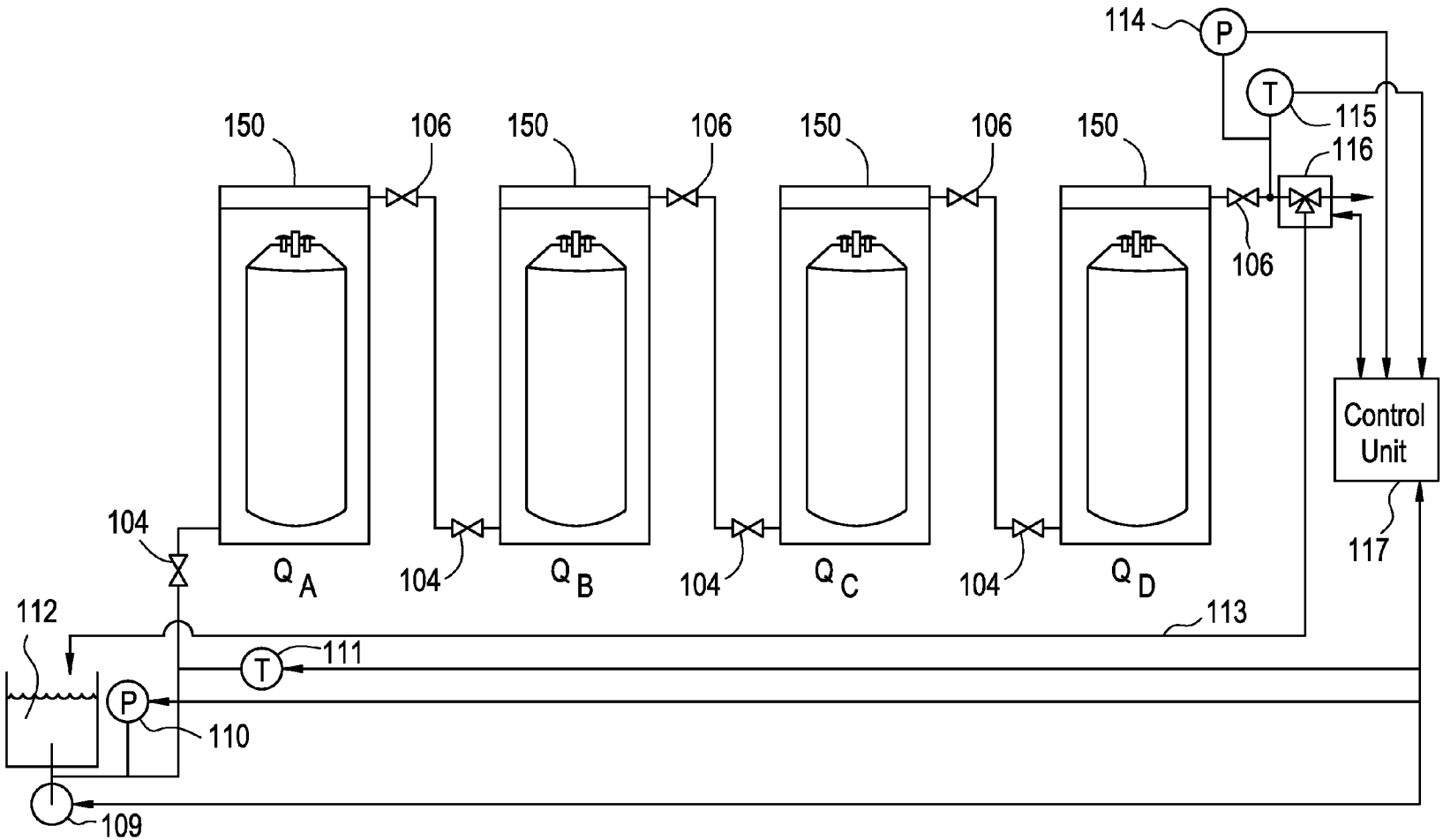
FIG. 3 illustrates a vapor forming system that includes a plurality of vapor forming apparatuses according to an example embodiment.

FIG. 3 illustrates a vapor forming system that includes a plurality of vapor forming apparatuses 150 according to an example embodiment. The vapor forming system includes a plurality of vapor forming apparatuses 150 (e.g., each vapor forming apparatus of FIG. 3 is the vapor forming apparatus 150 of FIG. 2), a storage unit 112 configured to hold the vapor forming liquid, a pumping unit 109, a first pressure monitoring unit 110, a first temperature monitoring unit 111, a switching valve unit 116, a second pressure monitoring unit 114, a second temperature monitoring unit 115, and a control unit 117 for controlling the switching valve unit 116 and/or the pumping unit 109.

Although FIG. 3 only illustrates four vapor forming apparatuses 150, the example embodiments encompass any number of vapor forming apparatuses 150. The plurality of vapor forming apparatuses 150 may be referred to as a train of vapor forming apparatuses or a train of heat sources. As previously explained with reference to FIG. 2, each vapor forming apparatus 150 includes an insulated container 102 that is configured to enclose a nuclear waste container 101. The nuclear waste container 101 includes the radioactive decay material. However, the vapor forming apparatuses 150 of FIG. 3 are connected in series with each other. For example, the outlet valve 106 of the first vapor forming apparatus 150 is connected to the inlet valve 104 of the second vapor forming apparatus via any connection member that supports the transfer of fluid. The other vapor forming apparatuses 150 are connected in the same manner. However, the outlet valve 106 of the last vapor forming apparatus 150 in the train of heat sources is connected to the switching valve unit 116.

The pumping unit 109 is configured to pump the vapor forming liquid from the storage unit 112 and transfer the vapor forming liquid through each insulated container 102 of the plurality of vapor forming apparatuses 150, where the radioactive decay material transfers heat to the vapor forming liquid in each stage. For example, the pumping unit 109 pumps the vapor forming liquid from the storage unit 112 and transfers the vapor forming liquid to the insulated container 102 of the vapor forming apparatus 150 via the inlet valve 104.

The first pressure monitoring unit 110 is configured to monitor the pressure of the vapor forming liquid that is transferred from the storage unit 112 to the first vapor forming apparatus 150. The first pressure monitoring unit 110 may be located between the storage unit 112 and the first vapor forming apparatus 150. The first temperature monitoring unit 111 is configured to monitor the temperature of the vapor forming liquid that is transferred from the storage unit 112 to the first vapor forming apparatus 150. The first temperature monitoring unit 111 may be located between the storage unit 112 and the first vapor forming apparatus 150. Also, the first temperature monitoring unit 111 and the first pressure monitoring unit 110 may not be two separate units. For example, the example embodiments encompass the situation where the first temperature monitoring unit 111 and the first pressure monitoring unit 110 are implemented in one unit. The first temperature monitoring unit 111 and the first pressure monitoring unit 110 may be any type of device(s) capable of monitoring temperature and/or pressure that is well known to one of ordinary skill in the art.

In the first stage, the radioactive decay material transfers heat ($Q_a$) to the vapor forming liquid. In the subsequent stage, the pumping unit 109 operates to transfer the heated vapor forming liquid from the first vapor forming apparatus 150 via the outlet valve 106 to the insulated container 102 of the second vapor forming apparatus 150 via the inlet valve 104. In this stage, the radioactive decay material transfers heat ($Q_B$) to the vapor forming liquid. The other vapor forming apparatuses 150 operate in the same manner. As a result, the vapor forming apparatuses 150 transfer heat to the vapor forming liquid based on the following equation:

$$Q_{total}=Q_A+Q_B+Q_C+Q_D \quad \text{Eq. (3)}$$

$Q_{total}$ is the total amount of heat transferred to the vapor forming liquid in the vapor forming system of FIG. 3. The parameters $Q_A$, $Q_B$, $Q_C$ and $Q_D$ represent the heat transferred in the stages of the vapor forming system. For example, the parameter $Q_A$ is the heat transfer for the first vapor forming apparatus 150, the parameter $Q_B$ is the heat transfer for the second vapor forming apparatus 150, the parameter $Q_C$ is the heat transfer for the third vapor forming apparatus 150, and the parameter $Q_D$ is the heat transfer for the fourth vapor forming apparatus 150. Each of the parameters $Q_A$, $Q_B$, $Q_C$, $Q_D$ is defined by Eq. (2). In other word, the pumped vapor forming liquid flowing through the inlet valve 104 of the first vapor forming apparatus 150 continues to flow through each insulated container 102 gaining thermal energy as shown in Eq. (3).

The second pressure monitoring unit 114 is configured to monitor the pressure of the vapor forming liquid that is transferred from the outlet valve 106 of the last vapor forming apparatus 150. The second pressure monitoring unit 114 may be located between the outlet valve 106 of the last vapor forming apparatus 150 and the switching valve unit 116. The second temperature monitoring unit 115 is configured to monitor the temperature of the vapor forming liquid that is transferred from outlet valve 106 of the last vapor forming apparatus 150. The second temperature monitoring unit 115 may be located between the outlet valve 106 of the last vapor forming apparatus 150 and the switching valve unit 116. Also, the second temperature monitoring unit 115 and the second pressure monitoring unit 114 may not be two separate units. For example, the example embodiments encompass the situation where the second temperature monitoring unit 115 and the second pressure monitoring unit 114 are implemented in one unit. The second temperature monitoring unit 115 and the second pressure monitoring unit 114 may be any type of device(s) capable of monitoring temperature and/or pressure that is well known to one of ordinary skill in the art. The pressure monitoring unit 114 and the temperature monitoring unit 115 at the exit of the train provide an indication of the thermodynamic properties of the vapor forming liquid.

The switching valve unit 116 is configured to receive the vapor forming liquid from the last vapor forming apparatus 150 and output vapor of the vapor forming liquid if at least one of the pressure and temperature is above a respective threshold. The threshold may be the point where energy conversion occurs (e.g., liquid to gas). However, if at least one of the pressure and temperature is equal to or below the respective threshold level, the switching valve unit 116 is configured to output the vapor forming liquid via a bypass line 113 to the storage unit 112. In other words, if the thermodynamic properties are too low for energy conversion to occur, the vapor forming liquid is returned to the storage unit 112 via the bypass line 113 during startup or source reload.

The control unit 117 is configured to control the operation of the switching valve unit 116 based on information received from the second pressure monitoring unit 114 and/or second temperature monitoring unit 115. For example, the control unit 117 is configured to receive temperature information and pressure information from the second temperature monitoring unit 115 and the second pressure monitoring unit 114, respectively, and control the switching valve unit 116 based on the temperature information and the pressure information. The control unit 117 controls the switching valve unit 116 to output the vapor of the vapor forming liquid if the pressure and temperature are high enough for energy conversion to occur by transmitting control information to the switching valve unit 116. Also, the control unit 117 controls the switching valve unit 116 to output the vapor forming liquid via the bypass line 113 if the pressure and temperature are not high enough for energy conversion to occur by transmitting control information to the switching valve unit 116. The control information includes information indicating whether to direct the flow of the vapor to a next stage circuit (e.g., the circuit of FIG. 1) or direct the flow of the vapor forming liquid back to the storage unit 112 via the bypass line 113. In addition, the control unit 117 may use temperature information from the first temperature monitoring unit 111 and the pressure information from the first pressure monitoring unit 110, in conjunction with the pressure and temperature information from the second pressure monitoring unit 114 and the second temperature monitoring unit 115 for controlling the switching valve unit 116.

Further, the control unit 117 may be configured to control the pumping unit 109 based on the information from the first pressure monitoring unit 110, the first temperature monitoring unit 111, the second pressure monitoring unit 114, the second temperature monitoring unit 115, and/or the thermocouples 107. For example, the control unit 117 may control the flow rate of the vapor forming liquid that is transferred throughout the from the storage unit 112 throughout the vapor forming apparatuses 150.

Figure 4:
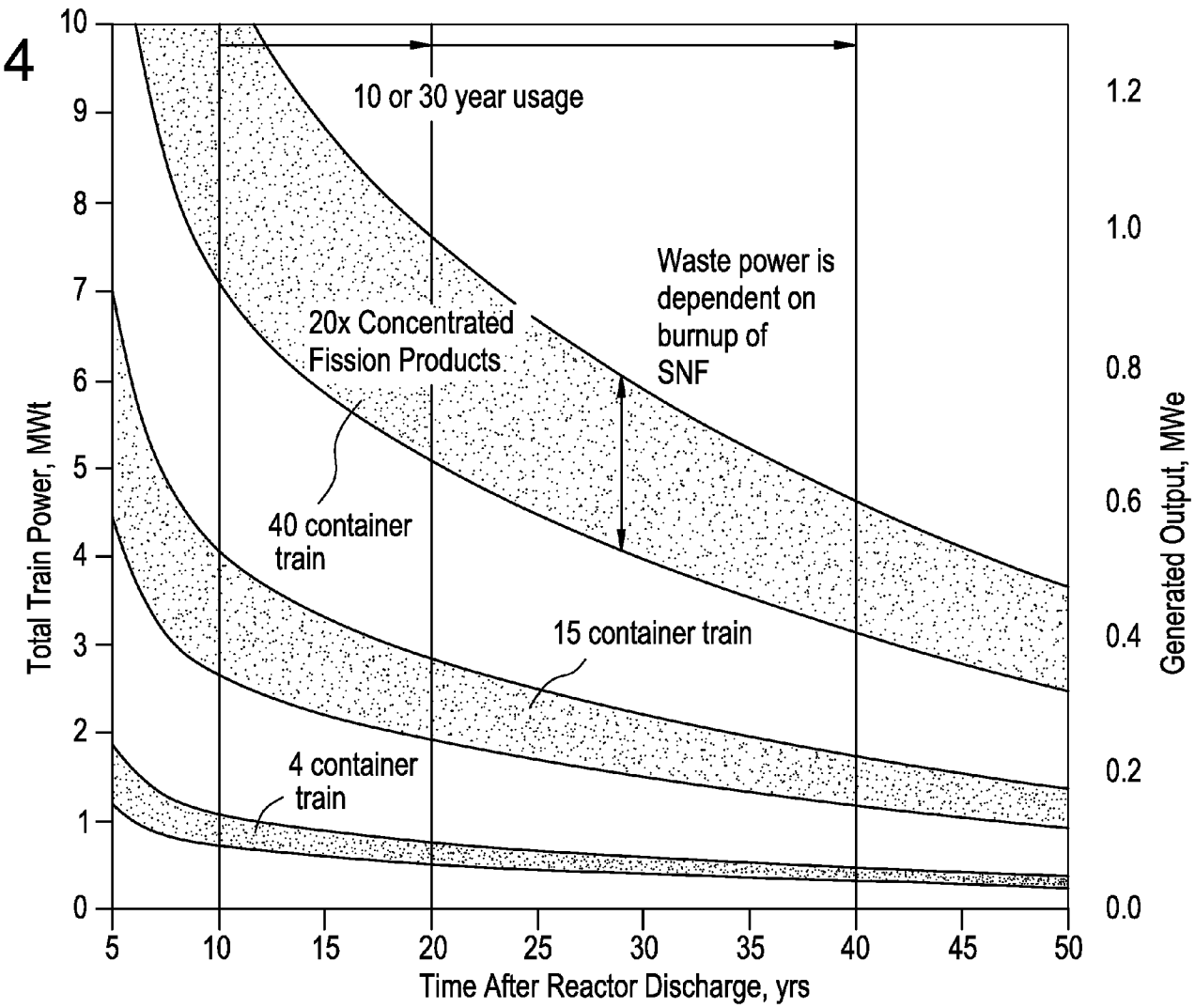
FIG. 4 illustrates expected electrical output and power generation for a different number of vapor forming apparatuses according to an example embodiment.

FIG. 4 illustrates power generation for a different number of vapor forming apparatuses according to an example embodiment. It is noted that the fission products within the nuclear waste container 101 are concentrated to 20 times than in current used nuclear fuel. FIG. 4 shows the heat generation rate for a 4-, 15- and 40-container train. The band in each curve, due to the waste power, is dependent on the used nuclear fuel burnup. Higher used nuclear fuel burnup will give the highest heat generation rate. The curve also shows that the relative heat generation rate from the 10th year to 40th year only varies by about 50%. This is a relatively significant and steady output of heat energy. The expected electrical output is based on 13% thermal efficiency, which is an average industry standard for generating electricity from low temperature heat sources.

Example embodiments provide an apparatus, system and method of operating a vapor forming coolant in which vapor is produced directly from a radioactive heat section. The system provides a constant power source or produces a constant heat source. This system has no regulation requirements and utilizes the inherent physical property of radioactive decay for heat production and bubble formation.

Example embodiments thus being described, it will be appreciated by one skilled in the art that example embodiments may be varied through routine experimentation and without further inventive activity. For example, although electrical contacts are illustrated in example embodiments at one side of an example reducing system, it is of course understood that other numbers and configurations of electrical contacts may be used based on expected cathode and anode assembly placement, power level, necessary anodizing potential, etc. Variations are not to be regarded as departure from the spirit and scope of the example embodiments, and all such modifications as would be obvious to one skilled in the art are intended to be included within the scope of the following claims.

What is claimed is:

1. A vapor forming apparatus, comprising:

an insulated container configured to enclose a nuclear waste container, the nuclear waste container including radioactive decay material, the insulated container including, an inlet valve configured to receive vapor forming liquid, the radioactive decay material transferring heat to the vapor forming liquid; and an outlet valve configured to output vapor formed by the radioactive decay material heating the vapor forming liquid;

a switching valve unit configured to receive the vapor forming liquid from the insulated container; and a control unit configured to control the switching valve unit to output vapor of the vapor forming liquid if at least one property of the vapor forming liquid is above a threshold, wherein the vapor forming liquid includes a mixture consisting essentially of one of (1) water and acetone and (2) water and alcohol.

2. The vapor forming apparatus of claim 1, further comprising:

at least one thermocouple configured to monitor the heat transferred to the vapor forming liquid.

3. The vapor forming apparatus of claim 1, wherein the insulated container includes a removable closure to insert the nuclear waste container into the insulated container.

4. A vapor forming system, comprising:

a storage unit configured to hold vapor forming liquid;

a plurality of vapor forming apparatuses that are connected to each other in series, each of the plurality of vapor forming apparatuses including an insulated container configured to enclose a nuclear waste container, the nuclear waste container including radioactive decay material;

a pumping unit configured to pump the vapor forming liquid from the storage unit and transfer the vapor forming liquid through each insulated container of the plurality of vapor forming apparatuses where the radioactive decay material transfers heat to the vapor forming liquid in each stage;

a switching valve unit configured to receive the vapor forming liquid from a last vapor forming apparatus of the plurality of vapor forming apparatus; and a control unit configured to control the switching valve unit to output vapor of the vapor forming liquid if at least one property of the vapor forming liquid is above a threshold.

5. The vapor forming system of claim 4, wherein the control unit is configured to control the switching valve unit to output the vapor forming liquid via a bypass line to the storage unit if the at least one property of the vapor forming liquid is equal to or below the threshold.

6. The vapor forming system of claim 4, wherein the vapor forming liquid includes a mixture of one of (1) water and acetone and (2) water and alcohol.

7. The vapor forming system of claim 4, wherein the at least one property of the vapor forming liquid includes temperature and pressure.

8. The vapor forming system of claim 7, further comprising:

a pressure monitoring unit configured to monitor the pressure of the vapor forming liquid; and a temperature monitoring unit configured to monitor the temperature of the vapor forming liquid, wherein the control unit is configured to receive temperature information and pressure information from the temperature monitoring unit and the pressure monitoring unit, respectively, and configured to control the switching valve unit based on the temperature information and the pressure information.

9. The vapor forming system of claim 8, wherein the pressure monitoring unit and the temperature monitoring unit are connected between an outlet valve of the plurality of vapor forming apparatuses and the switching valve unit.

10. The vapor forming system of claim 8, wherein the control unit controls the switching valve unit to output the vapor of the vapor forming liquid if the pressure and temperature are high enough for energy conversion to occur, the control unit controls the switching valve unit to output the vapor forming liquid via a bypass line to the storage unit if the pressure and temperature are not high enough for energy conversion to occur.

11. The vapor forming system of claim 4, wherein the insulated container for each vapor forming apparatus includes a removable closure to insert the nuclear waste container into the insulated container.

12. The vapor forming system of claim 4, further comprising:

a power module generator configured to receive the vapor from the switching valve unit and generate electrical energy based on the vapor.

13. A method of producing vapor, the method including:

transferring vapor forming liquid through a plurality of vapor forming apparatuses that are connected to each other in series, each of the plurality of vapor forming apparatuses including an insulated container configured to enclose a nuclear waste container, the nuclear waste container including radioactive decay material, the radioactive decay material transferring heat to the vapor forming liquid; and outputting vapor of the vapor forming liquid from a last vapor forming apparatus of the plurality of vapor forming apparatuses if at least one property of the vapor forming liquid is above a threshold.

14. The method of claim 13, further comprising:

outputting the vapor forming liquid via a bypass line to a storage unit if the at least one property of the vapor forming liquid is equal to or below the threshold, the storage unit holding the vapor forming liquid to be supplied to a first vapor forming apparatus of the plurality of vapor forming apparatuses.

15. The method of claim 13, wherein the vapor forming liquid includes a mixture of one of (1) water and acetone and (2) water and alcohol.

16. The method of claim 13, wherein the at least one property of the vapor forming liquid includes temperature and pressure.

17. The method of claim 16, further comprising:

monitoring the temperature and pressure of the vapor forming liquid, wherein the outputting step outputs the vapor of the vapor forming liquid if the pressure and temperature are high enough for energy conversion to occur, wherein the outputting step outputs the vapor forming liquid via a bypass line to a storage unit if the pressure and temperature are not high enough for energy conversion to occur.

18. The vapor forming apparatus of claim 1, further comprising:

a pressure monitoring unit configured to monitor the pressure of the vapor forming liquid; and a temperature monitoring unit configured to monitor the temperature of the vapor forming liquid, wherein the at least one property includes temperature information and pressure information from the temperature monitoring unit and the pressure monitoring unit, respectively.

* * * * *